US008584892B2

(12) United States Patent
Lira

(10) Patent No.: US 8,584,892 B2
(45) Date of Patent: Nov. 19, 2013

(54) PAPER ROLL AND WASTE WATER ENZYME TREATMENT

(76) Inventor: Joseph R. Lira, Crystal Beach, TX (US)

( * ) Notice: Subject to any disclaimer, the term of this patent is extended or adjusted under 35 U.S.C. 154(b) by 158 days.

(21) Appl. No.: 12/689,272

(22) Filed: Jan. 19, 2010

(65) Prior Publication Data

US 2010/0206893 A1 Aug. 19, 2010

Related U.S. Application Data

(60) Provisional application No. 61/207,724, filed on Feb. 17, 2009.

(51) Int. Cl.

| | |
|---|---|
| ***B65D 25/00*** | (2006.01) |
| ***C12N 11/18*** | (2006.01) |
| ***C12N 11/12*** | (2006.01) |
| ***C12N 11/10*** | (2006.01) |
| ***C12N 9/14*** | (2006.01) |
| ***C12N 9/20*** | (2006.01) |
| *C12Q 1/40* | (2006.01) |
| *C12Q 1/37* | (2006.01) |
| *C12Q 1/44* | (2006.01) |
| *C12Q 1/25* | (2006.01) |
| *C12Q 1/02* | (2006.01) |

(52) U.S. Cl.

USPC ..... 220/694; 435/22; 435/23; 435/24; 435/29; 435/174; 435/177; 435/178; 435/179; 435/182; 435/195; 435/198; 435/262.5

(58) Field of Classification Search

USPC ..... 220/23, 694; 435/22, 23, 24, 29, 174, 435/177, 178, 179, 182, 195, 198, 262.5

See application file for complete search history.

(56) References Cited

U.S. PATENT DOCUMENTS

| | | | | |
|---|---|---|---|---|
| 3,770,118 | A * | 11/1973 | Jones | 206/226 |
| 5,543,309 | A * | 8/1996 | Pischel | 435/177 |
| 6,743,361 | B1 * | 6/2004 | Doege et al. | 210/605 |
| 7,638,475 | B2 * | 12/2009 | Dwiggins et al. | 510/439 |

FOREIGN PATENT DOCUMENTS

WO WO 0240351 A1 * 5/2002

* cited by examiner

*Primary Examiner* — Jon P Weber
*Assistant Examiner* — Kailash C Srivastava
(74) *Attorney, Agent, or Firm* — Bernhard P. Molldrem, Jr.

(57) ABSTRACT

A packet of an enzyme and/or enzyme producing bacteria is contained within the core of a roll of toilet tissue or similar paper product wound on a core. The packet has a cover that dissolves or disintegrates on contact with water and disperses its contents into the aqueous waste stream. The packet may contain a mixture of bacterial cultures that produce enzymes to attack the greasy or fatty components of the waste stream. An additional article such as a sample of a liquid or creme personal care product may also be contained within the tissue paper core.

2 Claims, 1 Drawing Sheet

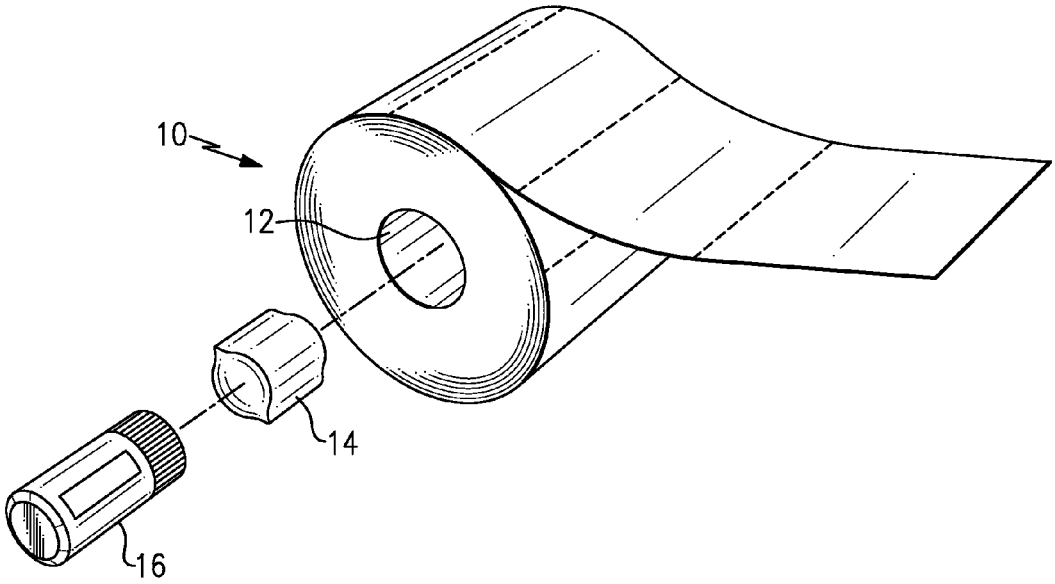
10
12
14
16

PAPER ROLL AND WASTE WATER ENZYME TREATMENT

This application claims priority of U.S. Ser. No. 61/207,724, filed Feb. 17, 2009

BACKGROUND OF THE INVENTION

The present invention relates to improvement of treatment of liquid wastes, and in more particularly concerned with pretreatment of an aqueous waste stream to help reduce the solid (i.e., insoluble in water) materials in the waste stream. The invention is more especially directed to a product and technique that permits the consumer, i.e., householder or commercial user of water and waste treatment, to facilitate the partial pre-treatment of solid, i.e., fatty or greasy materials in the waste stream.

Sewage treatment systems, which may be large municipal waste treatment systems or small, individual septic-tank systems, employ bacteria to help break down and neutralize the waste materials that are entrained in the waste water stream. Most of the reduction of solids in the waste stream is carried out by bacteria which digest these solids, especially proteinaceous matter and carbohydrate matter, by changing them into simpler compounds that can be easily dealt with. However, most of the bacteria used in waste water treatment are not particularly effective in digesting fatty materials, e.g., animal fat and grease. Consequently, these materials are only partially treated, and remain as a greasy residue known as sludge.

Enzymes are protein-based substances that act as catalysts to break up various organic molecules, which can include the sludge components. Enzymes are sometimes used in household drains as an additive treatment for clearing or unblocking the drain. The enzyme additive can be used in various plumbing systems, e.g., pipes, drains, toilets, septic tanks, etc.) to remove the sludge from the drain pipes and also to assist the septic tank bacteria.

Enzymes are consumed upon use, unlike bacteria which are living organisms that reproduce in the presence of waste water components. Consequently, the enzymes have to be replenished on a regular basis if they are used for neutralizing or converting sludge. However, there has not been any convenient and affordable technique proposed previously to allow the householder or commercial consumer to add any effective amount of sludge-reducing enzymes into the waste water drain system.

OBJECTS AND SUMMARY OF THE INVENTION

Accordingly, it is an object of this invention to provide a simple and effective technique and combination that permits an effective amount of enzymes to be injected in to the waste water drain system of a home, commercial establishment, or other source of aqueous waste, that will be effective in partially or completely pre-digesting the fatty or greasy materials (i.e., sludge) that is present in the waste water stream.

It is another object to provide a packet of enzyme material, e.g., enzymes and/or enzyme-producing bacteria, in a form convenient for the user to inject into the waste water drain.

It is more specific object to provide the packet of enzyme material within the void formed within the tubular paper core of a roll of toilet paper, a roll of paper towels, or other paper product in elongated form wound onto the core.

A similar object is to locate a useful article within the core of the toilet paper or paper towel roll, which may be in addition to the packet of enzyme material, which may include printed matter such as a coupon or special offer, information concerning environmental issues and conservation, or a sample size packet or bottle of a body creme, hair creme, or other personal care product.

In accordance with an aspect of the present invention a paper wipe product is combined with an enzyme treatment system useful in neutralizing solids in an aqueous waste stream. The paper product is in the form of a dispensable paper roll, e.g., a roll of toilet tissue, in which an elongated paper wipe product, i.e., toilet tissue, is wound around a hollow tubular core for dispensing. A water-soluble packet is located within the core, where it can be removed by the consumer for injection into the waste stream, e.g., by dropping the packet into the toilet bowl and flushing the toilet. Favorably, the water soluble packet includes an effective amount of an enzyme agent adapted for reducing fatty materials in the waste stream, and contained within a water-soluble enclosure. Favorably, the packet may be a hollow package made of paper adapted to dissolve in the aqueous waste stream. Alternatively, the enclosure of the packet may include the core, the core being formed of a paper that dissolves in the aqueous waste stream, the core being impregnated with the enzyme agent. This may be preferred for paper towels, where the core may be flushed down the toilet after the roll is depleted. The term water soluble covers also disintegration of the material in the presence of water as well as actual dissolution, such that the contents inside the packet contact the waste stream and become active. In either case, the dosage of enzymes is linked to the amount of waste material, based on the rate of usage of the toilet paper (or paper towels), so that the enzymes in the system are replenished at an optimal frequency.

In one preferred embodiment, the enzyme agent includes bacteria selected so that, in the presence of fatty materials in the waste stream, the bacteria produce enzymes that are effective for digesting those fatty materials, i.e., sludge. Favorably, the bacteria include a blend of bacteria cultures that are selected to produce amylase, cellulase, lipase, and protease. In one preferred embodiment, the packet contains substantially one-half ounce of the enzyme agent. A favorable formulation can be composed of an effective amount up to about 1% of viable bacteria; sodium chloride in an amount of 1% to 5%; sodium bicarbonate in an amount of 5% to 10%, monosodium phosphate and disodium phosphate together in an amount of 2% to 10%, and the balance a wheat-bran carrier (at least about 65%).

The invention can also be implemented as dispensable paper wipe product which can be disposed after use in a waste stream, where paper wipe product is disposed as a dispensable paper roll in which the elongated paper wipe product is wound around a hollow tubular core for dispensing. A useful auxiliary product is inserted into the core, and which is removable from the core when the paper product is put into use. In a favorable embodiment, as aforementioned, the useful auxiliary product is in the form of a water-soluble packet that includes an effective amount of an enzyme agent adapted for reducing fatty materials in the waste stream, and a water-soluble enclosure containing the enzyme agent. Alternatively or additionally, the useful auxiliary product can take the form of a personal care product in liquid form (e.g., body creme or skin creme) within a packet (such as a small plastic vial or a foil package). The packaged personal care product is dimensioned to fit within the void of the core. The auxiliary product can be a coupon or brochure that includes printed information. The information may be advertising for a related product, or may be related to water conservation, disease prevention, or other topic of public interest.

To encourage and obtain widespread usage of the enzyme product as a pretreatment, leading to beneficial effects on the environment (as well as a reduction of municipal waste treatment load) the enzyme packet should be inserted by the manufacturer inside the core of each roll of toilet paper or paper towel. Each time a new roll is opened, the enzyme packet would be removed and flushed down the toilet to continue the process of sludge reduction. The packet can also be torn open and emptied into a sink drain or shower drain to free the drain from organic buildup and to keep the drain pipes running and clear. For a typical household, a recommended dosage would be one half-ounce packet each three days. This corresponds approximately to the consumption rate of toilet tissue for the household.

As also mentioned, the enzyme package could be introduced into the drain piping of the wastewater system by disposing of an impregnated core into the toilet, i.e., where the core has been impregnated with the enzyme treatment, and where the core material is designed to disintegrate in the presence of water. This technique will also help resolve the solid waste problem of disposing of billions of the cardboard tubes (i.e., cores) that are consumed each year.

In the latter technique, the paperboard core is impregnated (or coated) with a material in which bacteria and/or enzymes are suspended within a paste or glue. This can be the adhesive that binds the inner end of the toilet paper or paper towel to the tubular core.

If the impregnated cores (or packets) are deposited in a landfill used for solid waste disposal, the result is a substantial reduction of accumulated solid waste, due to acceleration of waste degradation coupled simultaneously with an increase in methane production from the landfill. The acceleration of the waste reduction also reduces the amount of noxious fumes and smells. In the case of landfills, the specific bacteria cultures would be engineered and selected to facilitate this reduction process.

With this invention, a variety of bacteria and enzymes can be introduced effectively to address environmental concerns, and improve the performance of septic tank systems and cesspools. The invention also can be used as a pre-treatment to reduce the load of the aqueous waste stream upon a municipal waste water treatment plant.

Additional bacteria and/or enzymes can be added to the package to broaden its environmental capabilities. For example, reproductive abatement may be possible for control of mosquito larvae, snails, zebra mussels, or other parasites or nuisances, e.g., in locations where infestation has the effect of causing disease in humans or other species. The insertion of a disinfectant, antiseptic, or other personal hygiene product also assist in creating a sanitary environment, thus also reducing the spread of harmful microorganisms. Coupons, public information, or educational information within the core of the paper roll can foster commerce, introduce new products and concepts, and also educate the consumer concerning hygienic practices and waste reduction.

Currently, consumption estimates in the US are approximately 36 billion rolls of bathroom tissue, and another 5 billion rolls of paper towels. Thus, the use of packets within the rolls of such paper products represents an effective way of implementing the safe degradation of sludge in the waste water stream prior to leaving the consumer's waste water drain system.

The objects of this invention can be achieved using enzymes and bacteria that are considered safe for human contact and have been approved and considered non-hazardous by both the American and Canadian government authorities.

The above and many other objects, features, and advantages of this invention will become apparent to persons skilled in the art from the ensuing description of a preferred embodiment, which is to be read in conjunction with the accompanying Drawing.

BRIEF DESCRIPTION OF THE DRAWING

The sole FIGURE is a perspective view of a bathroom tissue roll and enzyme package, according to an embodiment of this invention.

DETAILED DESCRIPTION OF THE PREFERRED EMBODIMENTS

With reference to the Drawing, FIG. 1 shows a roll 10 of a paper product (e.g., a roll of toilet tissue) which is coiled or wrapped around a paperboard core 12. The core 12 is a hollow tube, and defines a cylindrical void within the core. Here a packet 14 is dimensioned to fit into the core void. The packet may be formed of a paper that dissolves (i.e., disintegrates) in water, so that when it is removed from the core and placed into the toilet bowl and flushed, it will release its contents. Here, the packet 14 contains about one-half ounce (about 15 grams) of an enzyme material, i.e., material containing either prepared enzymes or bacteria cultures that will produce enzymes, or both. An additional article 16, e.g., a small vial containing a sample of a personal care lotion, may be packed into the void of the core 12.

In a preferred implementation, the enzyme material includes a blend of viable bacterial cultures, up to about one percent. Sodium chloride (1% to 5%) and sodium bicarbonate (5%-10%) are present in the material, as are monosodium phosphate (5%-10%) and disodium phosphate (5%-10%). The balance of the material is a starchy base carrier, here wheat bran powder (at least about 65%). So long as the material is contained in the packet, the enzyme material is not considered as a skin hazard or irritant, and can be safely handled. In the concentrations present here, the bacterial cultures are considered safe and non-hazardous.

The blend of bacteria in a preferred embodiment are available under the name Genesis Blend, distributed by Clearwater Biosystems, Port Byron, N.Y. The bacterial cultures are selected, as a multi-spore formulation, to improve liquefaction and digestion of fats, oils, greases and organic deposits that may cause drain line blockages in residential and commercial applications. The bacteria produce hundreds of enzymes in response to organics that are present in their environment. The bacteria produce extracellular enzymes that break-down proteins, starches, fats, oils, greases, and the paper fibers into small particles outside the cell membranes. The bacteria then transport the breakdown materials across the cell membranes for use as energy sources for building new cellular components, so the bacteria cultures can reproduce. That is, when the bacteria sense the organic materials present as potential food, they produce extracellular enzymes to break down the organic materials. Then the breakdown materials are consumed and the bacteria multiply to increase the number of bacteria present.

The bacteria culture blend utilizes the organics present in the aqueous waste stream to produce key extracellular enzymes, which include amylase, cellulase, lipase, and protease. The bacteria are selected to achieve rapid production of these key enzymes, so as to produce optimal results in destroying the sludge in drain lines, and to keep drain lines clear and odor-free.

The key enzymes break down the fatty or greasy component into simpler molecular component, e.g., water and methane. This eliminates odors that may be caused by incomplete digestion of the fatty acids which would otherwise produce volatile and malodorous organic components. The bacterial cultures employed here are effective in both aerobic and anaerobic environments and conditions.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. A combination paper wipe product and enzyme treatment system useful in neutralizing solids in an aqueous waste stream, comprising:

a dispensable paper roll in which an elongated paper wipe product is wound around a hollow tubular core for dispensing, the core defining a tubular void; and a water-soluble packet removably inserted in the core for injection into said waste stream, the water soluble packet consisting of an effective amount of an enzyme agent adapted for reducing fatty materials in the waste stream, and a water-soluble enclosure containing said enzyme agent; wherein said enclosure is in the form of a hollow package made entirely of a paper that is adapted to dissolve in the aqueous waste stream;

said water-soluble packet being adapted to be injected into the waste stream prior to dispensing of the paper wipe product from the roll.

2. A dispensable paper wipe product which can be disposed after use in a waste stream, comprising;

a dispensable paper roll in which an elongated paper wipe product is wound around a hollow tubular core for dispensing, the core defining a tubular void; and a useful auxiliary product removably inserted into the core, and which is removable from the core when the paper product is initially put into use;

wherein the useful auxiliary product is in the form of a water-soluble packet that consists of an effective amount of an enzyme agent adapted for reducing fatty materials in the waste stream, and a water-soluble enclosure containing said enzyme agent.

* * * * *